United States Patent [19]

Kozlov

[11] 4,055,050

[45] Oct. 25, 1977

[54] APPARATUS FOR AND METHOD OF REGASIFYING LIQUEFIED NATURAL GAS

[76] Inventor: Vladimir Borisovich Kozlov, ulitsa Butlerova, 2, korpus 2, kv. 134, Moscow, U.S.S.R.

[21] Appl. No.: 657,297

[22] Filed: Feb. 11, 1976

[51] Int. Cl.[2] ..... F01K 13/00

[52] U.S. Cl. ..... 60/692; 60/652; 60/667; 60/670

[58] Field of Search ..... 60/652, 660, 664, 665, 60/667, 690, 692, 670

[56] References Cited

U.S. PATENT DOCUMENTS

| | | | |
|---|---|---|---|
| 3,628,332 | 12/1971 | Kelmar | 60/652 |
| 3,886,749 | 6/1975 | Pacault | 60/652 |

*Primary Examiner*—Allen M. Ostrager

[57] ABSTRACT

A steam power plant includes a boiler unit heated by gas supplied from a pipeline for converting water into steam; the gas may be stored as reserve liquefied gas. A turbine is powered by the steam generated by the boiler unit, and the steam gives up energy to power the turbine; a condenser receives energy-depleted steam from the turbine and includes a cooling circuit with water circulation, and a storage facility for the reserve liquefied gas. A heat exchanger is used for regasifying the liquefied gas and at least a portion of the cooling circuit is in heat-exchange contact with the liquefied gas, so that the liquefied gas is regasified by way of step regasification and supplied to the boiler unit upon a deficiency of gas occurring in the pipeline.

6 Claims, 1 Drawing Figure

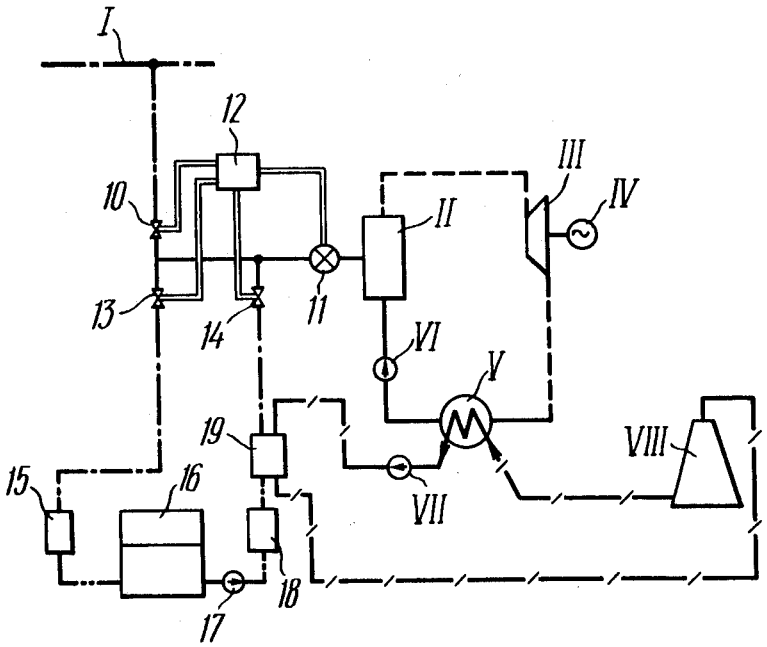
I
12
10
13
14
11
II
III
IV
VI
V
19
VII
VIII
15
16
17
18

APPARATUS FOR AND METHOD OF REGASIFYING LIQUEFIED NATURAL GAS

The present invention relates to steam plants and more particularly, to an apparatus used at a steam power plant when there is a deficiency of gaseous fuel.

One of the main problems encountered when operating steam plants is ensuring maximum reliability of their operation. In some cases, the reliability of a steam power plant is more important than its technical and economical efficiency. Delays in the fuel supply during the period when fuel consumption is maximum, i.e. during the period of winter peak load, may reduce the efficiency of a power plant in comparison with the load requirements and may cause a complete shut-down of the power plant under emergency conditions. Most steam power plants operating in summer time on natural gas use in winter a different type of fuel (mazut, coal). Limited capacities of storage facilities and possible delays in the fuel stock at power plants may cause a breakdown of the power supply. Considered in what follows are measures ensuring, by storing liquefied gas, reliable operation of a steam power plant operating solely on gaseous fuel during the whole year without increasing the flow rates through the gas pipeline of the power plant even when gas supply to the power plant is cut off.

Natural gas is the most convenient and efficient fuel to be used at modern steam power plants. In view of a considerable increase of the gas output and its importance in the overall energy balance of a country's economy, as well as higher efficiency of gas pipelines, almost all steam power plants turn to using natural gas.

Natural gas used at steam power plants raises greatly the efficiency thereof in comparison with other types of fuel, and minimizes pollution of the environment.

When using natural gas, the mode of operation of a steam power plant as a whole depends upon gas flow rates in the supply pipeline. This feature is due to the fact that at present, no reliable and efficient methods of storing gas fuel at steam power plants are known and this problem is solved effectively in the case of solid and liquid fuel only at steam power plants using natural gas, the latter being fed directly from the main pipeline to the boiler unit for combustion through the gas supply pipeline of a steam power plant. In summer, the main pipeline has an excessive throughput capacity; however, at steam power plants the load is reduced due to the absence of thermal energy consumers and a decrease in the public electric energy consumption. In winter, due to the deficiency of natural gas, steam power plants which normally use gaseous fuel, partially and sometimes completely turn to using solid and liquid fuel (or combined fuel). Therefore, a steam power plant should be provided with storage facilities for fuel to be consumed during "peak load" periods, devices for supplying the fuel for combustion in the furnace, as well as additional types of burners. This equipment and useful areas are used only during certain periods of a year. This factor substantially complicates the operation of a steam power plant and raises the cost of the thermal and electric energy produced. Intensification of consumption of thermal and electric energy as well as gaseous fuel concurrently with the impossibility of storing adequate amounts of gas at steam power plants affect their performance and economical efficiency in winter.

It is an object of the present invention to provide an apparatus for regasifying liquefied natural gas, which will permit the process of regasifying to be carried out without any additional fuel consumption.

It is another object of the invention to provide for a reduction of auxiliary power consumption and the required circulation rate.

It is still another object of the invention to provide a regasifying apparatus with a comparatively reduced ecologically adverse effect upon the environment.

It is yet another object of the invention to provide a regasifying apparatus which will ensure continuous trouble-free operation of the heat-exchanger of the regasifying apparatus without frosting its heating surfaces.

A further object of the invention is to provide a highly economically efficient regasifying apparatus not expensive in manufacture and operation.

These and other specific objects of the present invention are attained by providing an apparatus for regasifying liquefied natural gas at a steam power plant having a steam plant with a boiler unit, a steam turbine, a condenser with a cooling circuit with circulating water and a storage facility for reserve liquefied gas which, when there is a deficiency of fuel, is supplied into the boiler unit by way of step regasification thereof. This regasifying apparatus is characterized in that the last step of the regasified fuel supply includes a heat-exchanger also incorporating a portion of the cooling circuit with circulating water for the regasified fuel.

The apparatus according to the invention exhibits the following advantages in operation:

- the regasification is carried out without additional fuel consumption, but solely at the expense of the heat released by the water in the cooling circuit of the condenser;
- in the heat exchange process, the temperature of the cooling circuit water is reduced at the inlet of the condenser, thus permitting the circulation rate and auxiliary power consumption to be substantially cut down; and
- all other conditions being equal (supplied heat, output power), heat released into the environment is minimized, thus mitigating the ecologically adverse effects upon the environment.

According to one of the embodiments of the present invention the regasifying apparatus is characterized in that the circuit of the gaseous fuel being regasified, the portion between the liquefied gas storage facility and the heat-exchanger incorporates at least one assembly for preheating the gaseous fuel to be regasified at temperatures ranging from 160° to 80° C.

The above embodiment of the present invention makes it possible to preclude frosting on the heating surface by regasifying liquefied gaseous fuel at a definite temperature step, and to provide for reliable and trouble-free continuous operation of the heat-exchanger regasificator.

According to another embodiment of the present invention, the regasifying apparatus is characterized in that the preheating assembly is a heat-exchanger with a low-boiling working medium (freon) circulating therein, the heat-exchanger being essentially a condenser in an additional turbine plant operating on freon vapours.

In this embodiment of the present invention, it is advisable to use the interval between the temperature of the water circulating in the circuit for cooling the condenser (heat source) and that of the heat-exchanger-regasificator (heat removal). The application of the temperature interval in a cycle with a low-boiling working medium makes it possible to attain useful work in the form of electric power in the turbine cycle of conversion.

Specific features and advantages of the present invention will appear more completely from the following detailed description of a preferred embodiment thereof with due reference to the accompanying drawing, which is a schematic diagram of an apparatus for regasifying liquefied natural gas at a steam power plant, according to the invention.

The proposed method of storing liquefied natural gas at a steam power plant eliminates the necessity to switch the steam power plant over to operation on another type of fuel in winter. The prior art methods for storing natural gas under pressure in a liquid phase do not permit accumulating considerable volumes of this fuel, while the capital investments for the construction of storage gas-holders involve large consumption of metal and other expenditures. The use of natural reservoirs for accumulating natural gas (abandoned mines and the like) is possible in some areas only at reasonable distances from steam power plants and involves a number of technical difficulties.

The method of storing natural gas according to the invention is based on the principle of creating reserves of liquefied gas stored in isothermal tanks under atmospheric pressure. Since the density of liquefied gas is 750–800 times greater than that of the gaseous phase, the method permits accumulation in reservoirs of suitable sizes of large amounts of fuel, thereby compensating for its deficiency during peak periods over a long stretch of time.

Referring now to the drawing, the steam power plant comprises the following main elements of a steam plant fed with gas from a main gas pipeline I: a boiler unit II, a turbine III, an electric power generator IV, a condenser V, a feed pump VI, a condenser cooling reversible system pump VII and a cooling tower VIII. According to the proposed method, gaseous fuel is supplied to the steam power plant from the main gas pipeline 1 through a common valve 10 controlled by a transmitter 11 of an adder 12 which feeds a control signal of the required fuel consumption determined for a given time of the steam power plant operation. The type of control signals fed by the adder 12 to the valve 10 as well as to valves 13, 14 may be determined automatically as a function of the planned heat and electric power load or directly by the load dispatcher. During periods when the load is reduced and, therefore, the required fuel consumption is also lower, and when an excess of gas is available in the main gas pipeline 1 (summer months as well as night hours in the transition periods of seasonal schedules), the adder 12 initiates a control signal which, with the valve 10 being open, actuates the valve 13, and natural gas is fed into a liquefied system 15, wherefrom the liquefied gas is supplied into a liquefied gas isothermal storage 16. The period of operation of the system in the mode of liquefied gas accumulation is defined by (a) the capacity of the isothermal storage whose optimum sizes should be based on economic criteria according to the power rate of the steam power plant and possible periods when the steam power plant is switched over to using "peak" fuels in the absence of buffer reserves of gas; (b) the excessive amount of gaseous fuel in the main gas pipeline 1, which is determined by the gas flow rate therein and gas consumption schedule at the steam power plant.

During the period when excessive amount of gas in the feeding gas pipeline is reduced, according to the control signals from the adder 12 the flow rate of the gas fed for liquefaction is reduced by closing the valve 13. Hence, the fuel flow rate to the boiler unit II is maintained constant or according to the preset load schedule by means of the flow rate transmitter 11 and by comparing the information provided by the flow rate transmitter 11 to the adder 12 with the load requirements preset automatically or by the load dispatcher.

When the valve 10 is fully opened and the gas flow rate in the main pipeline is less than that required by the load or when the gas supply into the main pipeline 1 is completely cut off (in winter), the system passes from accumulation over to consumption. Hence, the adder 12 initiates a control signal to open the valve 14 and the liquefied gas from the isothermal storage 16 is delivered by the pump 17, which is cut on automatically, to the regasifying system comprising a preheating assembly 18 and a heat-exchanger 19. The assembly 18 is a heat-exchanger with low-boiling freon circulating therein, and more specifically it is a condenser in the additional turbine unit operating on freon vapours. Furthermore, gaseous fuel is delivered for combustion into the boiler unit II. When the system operates in the mode of consumption, two cases are possible. In the first case, the main pipeline 1 feeds gas to the steam power plant at a flow rate less than that required by the load. Signals from the transmitter 11 and commands from the adder 12 applied to the valve 10 (for full opening), valve 13 (full closing) valve 14 (follow-up operation) permit maintaining a constant flow rate of the gaseous fuel into the boiler unit II according to the requirements of the load. In the second case, the main pipeline 1 cuts off fully the gas supply to the steam power plant (the busiest period in the gas supply in a given area in winter). Signals from the transmitter 11 and commands from the adder 12 actuate the valve 14 to set the mode of operation when the gas flow rate to the boiler unit II according to the load requirements is equal to that from the isothermal storage 16 through the pump 17 and the regasifying system 18, 19. The duration of the self-contained operation of the steam power plant in the mode of consumption by using the reserves of liquefied gas is determined by the capacity of the isothermal storage 16 whose size should be defined from technical and economical considerations.

The importance of reliability in the operation of steam power plants is obvious and has already been mentioned above. To solve the problem of reliability in fuel supply to a steam power plant operating on a single gaseous fuel when no substitute fuel is used, the problems of reserving fuel and controlling the fuel supply according to the load requirements should be solved in the proposed system. When the required flow rates of the fuel exceeds the capacity of the main gas supply pipeline of a steam power plant, the system according to the invention may operate according to a program preset automatically by the adder 12 to compensate for the deficiency of gas by using the gaseous fuel taken from the isothermal storage of liquefied gas. Therefore, in addition to the objects attained by the system for storing gaseous fuel, the apparatus according to the invention and shown in the drawing may be regarded as an automatic gaseous fuel supply control system at steam power plants.

Within the scope of the proposed method for storing fuel, a series of measures can be taken aimed at internal regeneration, using low potential heat and so on may be taken to enhance the technical and economical performance of the system as a whole. In particular, the drawing shows that the water of the reversible system for cooling the condensers can be used at the last step of the regasification process (heat-exchanger 19). This feature reduces heat consumption by regasification and due to a drop of the water temperature in the reversible system used for cooling the condensers permits reduction of the water circulation rate, thus reducing respectively auxiliary electric power consumption at the steam power plant.

When describing the proposed method for building up reserves of gaseous fuel at a steam power plant, consideration is given to the principle of operation of the system as a whole, but such important factors as (a) liquefaction system (cycle, working medium and the like); (b) cooling unit for keeping the natural gas in the liquefied phase in the case of storage in the isothermal facility; (c) method for feeding heat to the liquefied gas supplied to the regasification system, are not considered in detail. These are well known to those skilled in the art and the required equipment may be supplied by the industry.

The proposed method for storing gaseous fuel at steam power plant offers the following important advantages:

1. The reliability of the steam power plant operation in the system is raised by minimizing the probability that the load requirements during periods of its sharp increase will not be met due to the gaseous fuel necessary for the given period of time not being availabe.

2. There is no necessity for a steam power plant to turn to using other types of fuels in winter (in winter, the efficiency of the steam power plant increases, standby systems for receiving, storing, feeding and burning other types of fuel become unnecessary, as well as the system for ash removal when coal is used as a substitute fuel and the like), thus improving the economic performance.

3. The flexibility of responding to load fluctuations at a steam power plant is enhanced due to the possibility to effect continuous control of the gaseous fuel supply within a wide range.

4. The possibility to increase the power output of a steam power plant due to the fact that the storage facilities, fuel delivery lines and systems for handling substitute fuels become available.

5. Independent operation of a steam power plant is possible when gas supply from the main pipeline is fully cut off. The time of independent operation of the steam power plant is determined by the capacity of the isothermal storage of liquefied gas and, therefore, can be varied efficiently within a required range.

6. The possibility to establish an automatic system for controlling the fuel supply to the steam power plant and an automatic system for controlling the power units as a whole by using advanced computers.

7. The possibility to maintain a relationship between "hot" and "cold" thermodynamic cycles of a steam power plant, liquefaction systems, isothermal storage and regasification of natural gas to raise the thermodynamic and technical-economic efficiency of the system as a whole. For example, it is possible to reduce the water circulation rate in the reversible system used for cooling the condenser, hence, the auxiliary electric power consumption at the steam power plant, by using the water fed from the condenser to regasify the liquefied natural gas (heat-exchanger 19 of the system of regasification by the water circuit, the portion between the condenser V and the cooling tower VIII).

8. Minimum atmospheric pollution in winter owing to the steam power plant operating in winter on natural gas.

9. Minimum heat releases to the environment through the use of the water of the reversible system for cooling the condensers to regasify the liquefied gas when the steam power plant operates in the mode of consumption. This feature together with the minimized atmospheric pollution (Item 8) meet the requirements of protection of natural resources which are becoming more stringent at present.

10. Possibility of applying efficiently the methods for storing liquefied natural gas at future steam power plants and units.

What is claimed is:

1. A steam power plant comprising:

a boiler unit heatable by gas supplied from a pipeline for converting water into steam, at least part of the gas being storable as reserve liquefied gas;

a turbine powered by the steam generated by said boiler unit, the steam giving up energy to power said turbine;

a condenser for receiving the energy-depleted steam from said turbine, said condenser including a cooling circuit having water circulation; a storage facility for the reserve liquefied gas; and heat exchanger means for regasifying the liquefied gas, at least a portion of said cooling circuit being in heat-exchange contact with the liquefied gas, whereby the liquefied gas is regasified by way of step regasification and supplied to said boiler unit upon a deficiency of gas occurring in the pipeline.

2. A steam power plant according to claim 1 further comprising at least one assembly interconnected between a liquefied gas storage facility and said heat-exchanger means for preheating the liquefied gas to be regasified to a temperature within a range from 80° to 160° C.

3. A steam power plant according to claim 2, wherein the liquefied gas pre-heating assembly comprises second heat exchanger means for having a low-boiling point fluid circulating therein.

4. A steam power plant according to claim 3, wherein said turbine includes a second turbine operable by the low-boiling point fluid, said second heat exchanger means including a second condenser for condensing said low-boiling point fluid.

5. A steam power plant according to claim 4, wherein the low-boiling point fluid is freon.

6. A method of regasifying liquefied gas comprising the steps of:

supplying gas to a power plant in gaseous form;

liquefying the gas for storage;

releasing heat not convertible into useful energy from the power plant;

heating at least a portion of the liquefied gas by the power-plant released heat for regasifying the liquefied gas into the gaseous form; and resupplying the regasified gas to the power plant upon a deficiency of the gas supplied to the power plant occurring.

* * * * *